US011493059B2

(12) United States Patent
Stefanovic et al.

(10) Patent No.: US 11,493,059 B2
(45) Date of Patent: Nov. 8, 2022

(54) AIR GENERATION SYSTEM COMPRISING AN ELECTROMECHANICAL DEVICE, A CASING AND AN ELECTRONIC CARD

(71) Applicant: SAFRAN ELECTRICAL & POWER, Blagnac (FR)

(72) Inventors: Nicolas Stefanovic, Bouloc (FR); Jacques Deleris, Blagnac (FR); Guillaume Boulet, L'Isle Jourdain (FR)

(73) Assignee: SAFRAN ELECTRICAL & POWER, Blagnac (FR)

( * ) Notice: Subject to any disclaimer, the term of this patent is extended or adjusted under 35 U.S.C. 154(b) by 495 days.

(21) Appl. No.: 16/500,562

(22) PCT Filed: Apr. 4, 2018

(86) PCT No.: PCT/FR2018/050835
§ 371 (c)(1),
(2) Date: Oct. 3, 2019

(87) PCT Pub. No.: WO2018/185430
PCT Pub. Date: Oct. 11, 2018

(65) Prior Publication Data

US 2020/0102971 A1 Apr. 2, 2020

(30) Foreign Application Priority Data

Apr. 4, 2017 (FR) ..... 17 52879

(51) Int. Cl.
*F04D 29/58* (2006.01)
*F04D 25/06* (2006.01)
*F04D 29/42* (2006.01)

(52) U.S. Cl.
CPC ..... *F04D 29/5806* (2013.01); *F04D 25/068* (2013.01); *F04D 29/4206* (2013.01); *F04D 29/5813* (2013.01)

(58) Field of Classification Search
CPC .. H02K 9/04; H02K 9/02; H02K 9/00; H02K 9/06; H02K 9/14; F04D 29/5813; F04D 25/068; F04D 29/4206; F04D 29/5806
See application file for complete search history.

(56) References Cited

U.S. PATENT DOCUMENTS 3,538,361 A * 11/1970 Haut ..... H02K 11/046 310/58
4,608,819 A 9/1986 Colman et al.
(Continued)

FOREIGN PATENT DOCUMENTS

EP 2 557 204 A1 6/1985
EP 2 607 651 A2 6/2013

OTHER PUBLICATIONS

International Search Report dated Jun. 27, 2018 in PCT/FR2018/050835 filed on Apr. 4, 2018.
(Continued)

*Primary Examiner* — Jesse S Bogue
(74) *Attorney, Agent, or Firm* — Oblon, McClelland, Maier & Neustadt, L.L.P.

(57) ABSTRACT

A system for generating air includes: an electromechanical device generating an airflow equipped with an air inlet opening and an outlet; a casing extending between a first end attached to the air inlet opening and a second end located opposite the first end, the casing including two parts together defining a closed recess, each part including a hollow wall defining a channel extending between the two ends of the casing, each channel opening in front of the air inlet opening so that the electromechanical device is supplied with air routed by the channels; and at least one electronic card for power supply or control of the electromechanical device located in the recess of the casing.

7 Claims, 3 Drawing Sheets

(56) References Cited

U.S. PATENT DOCUMENTS 5,863,185 A * 1/1999 Cochimin ..... F04D 13/10 417/43
6,927,511 B2 * 8/2005 Cleanthous ..... H02K 9/06 310/58
7,042,121 B2 * 5/2006 De Filippis ..... F04D 25/082 310/58
7,547,487 B1 * 6/2009 Smith ..... H01M 50/562 429/57
7,975,637 B1 * 7/2011 Nida ..... B63J 2/02 114/211
2002/0187059 A1 * 12/2002 Gold ..... F04D 29/5806 417/354
2004/0118128 A1 * 6/2004 Bruno ..... F02C 7/32 60/801
2005/0066680 A1 * 3/2005 Hobmeyr ..... H01M 8/0668 62/7
2009/0108715 A1 * 4/2009 Sopp ..... H02K 9/227 310/60 A
2011/0100253 A1 5/2011 Koyama et al.
2012/0112537 A1 * 5/2012 Fukazu ..... B60R 16/0207 903/904
2014/0165531 A1 6/2014 Broughton et al.
2017/0021489 A1 * 1/2017 Bylund ..... F04D 19/002
2017/0098873 A1 * 4/2017 Tsuchiya ..... H01M 50/505
2017/0191420 A1 * 7/2017 Clarke ..... F01D 17/145
2019/0145657 A1 * 5/2019 Pirouzpanah ..... F04D 17/06 126/11 OR

OTHER PUBLICATIONS

Chinese Office Action dated Sep. 1, 2020 in Chinese Patent Application No. 201880025534.6 (submitting English translation only), citing document AA therein, 7 pages.

* cited by examiner

AIR GENERATION SYSTEM COMPRISING AN ELECTROMECHANICAL DEVICE, A CASING AND AN ELECTRONIC CARD

BACKGROUND OF THE INVENTION

The invention relates to an air generating system formed from an electromechanical device generating an airflow, a casing and at least one electronic card, this system being able to be implemented in particular within the scope of aeronautical applications.

Various electromechanical devices generating airflows are known, such as blowers or air compressors. An air compressor for a fuel cell can, for example, be integrated into an aircraft turbine engine.

These electromechanical devices also comprise a duct forming an air inlet stream in the device and are also associated with electronic components configured to ensure their power supply as well as their control.

Various solutions relating to the integration of these electronic components are known from the prior art.

A first known solution consists of attaching the electronic components by applying them to the exterior edges of the duct forming the air inlet stream of the electromechanical device, one after the other, depending on the space available. By way of an example, the electronic components are located in a protective casing around the air inlet stream. An integration of this type is not optimal, however. In fact, it involves in particular the segregation of electronic components on various electronic cards, leading to the attainment of large volumes around the duct forming the air inlet stream, compared to its small diameter. Devices of this type equipped with their electronic cards can, moreover, have integration problems, particularly when it is desired to use them in an aircraft.

In order to reduce the volume occupied by the electromechanical device and its electronic components, a known alternative solution consists of integrating part of the electronic components in a protective casing forming a volume located on the duct of the electromechanical device, and part of the electronic components in a nose cone of a drive motor constitutive of the electromechanical device. The electronic components are again distributed between different electronic cards. Although the volume occupied around the air inlet stream of the device is thus reduced with respect to the preceding solution, it nevertheless still remains relatively large for the purpose of its integration. This solution requires, moreover, the passage of cables between the drive motor nose cone of the electromechanical device and the exterior body of the duct in order to ensure connections between the different electronic cards. Thus, a solution of this type can lead to a deterioration in the performance of the electromechanical device.

Moreover, for all of the aforementioned solutions, the segregation of the electronic components between different electronic cards necessitates the creation of multiple inter-card wired connections, these connections increasing the emission of parasitic radiation. Existing solutions are therefore proving to be limited, and there exists a need to reduce the volume occupied by these devices, particularly for the purpose of integrating them into an aircraft.

OBJECT AND SUMMARY OF THE INVENTION

The present invention has as its goal to correct the aforementioned disadvantages.

To this end, the invention proposes a system for generating air comprising:

- an electromechanical device generating an airflow equipped with an air inlet opening and an outlet,
- a casing extending between a first end attached to the air inlet opening and a second end located opposite the first end, said casing comprising two parts together defining a closed recess, each part comprising a hollow wall defining a channel extending between the two ends of the casing, each channel opening in front of the air inlet opening so that the electromechanical device is supplied with air routed by the channels, and
- at least one electronic card for power supply or control of the electromechanical device arranged in the recess of the casing.

The creation of a channel for airflow in each part forming the casing allows dispensing with the creation of a single central air circulation duct, and thus providing in the casing a recess intended to receive an electronic card. It thus becomes possible to integrate a dedicated electronic card for control and power supply of the electromechanical device. Unlike the prior art requiring a plurality of electronic cards, the present invention allows reducing the volume occupied by the control and power electronics, expanding the possibilities of integration of a system of this type, particularly in aircraft. The use of a single electronic card also allows a reduction in the costs of manufacturing of the control and power supply electronics, as well as elimination of the inter-card connections. The elimination of the inter-card connections leads in particular to a reduction in parasitic electromagnetic emissions and allows eliminating inter-card functional dependencies. The reliability of the control and power supply electronics is thereby improved. An improvement in mass is also obtained via a reduction in the number of inputs/outputs previously linked to the inter-card connection. Moreover, the air aspirated by the device is routed in the interior of the channels along the recess formed by the assembly of the parts of the casing, thus allowing the cooling of the electronic components of the device, the heat emitted by the latter being removed via the circulation of air through the channels.

In one exemplary embodiment, the parts of the casing can be attached together by means of flanges, two corresponding flanges defining together a cavity in communication with a recess of the casing, a part of the electronic card being housed in said cavity. Thus, the assembly of the two respective flanges on either side of the casing allows the provision of an additional volume for the insertion of the electronic card between the parts of the casing.

In one exemplary embodiment, the casing can be made of aluminum.

In one exemplary embodiment, the electromechanical device can be an air compressor or a blower.

The invention also proposes, according to another aspect, a fuel cell system comprising a fuel cell and an air compressor intended to supply air to the fuel cell, the air compressor being constitutive of the system for generating air summarized above.

The invention also proposes, according to another aspect, an aircraft turbine engine comprising the system for generating air summarized above.

The invention also proposes, according to another aspect, an aircraft comprising the above turbine.

BRIEF DESCRIPTION OF THE DRAWINGS

Other features and advantages of the invention will be revealed by the following description of particular embodiments of the invention, given by way of non-limiting examples, with reference to the appended drawings, in which.

DETAILED DESCRIPTION OF EMBODIMENTS

Figure 1:
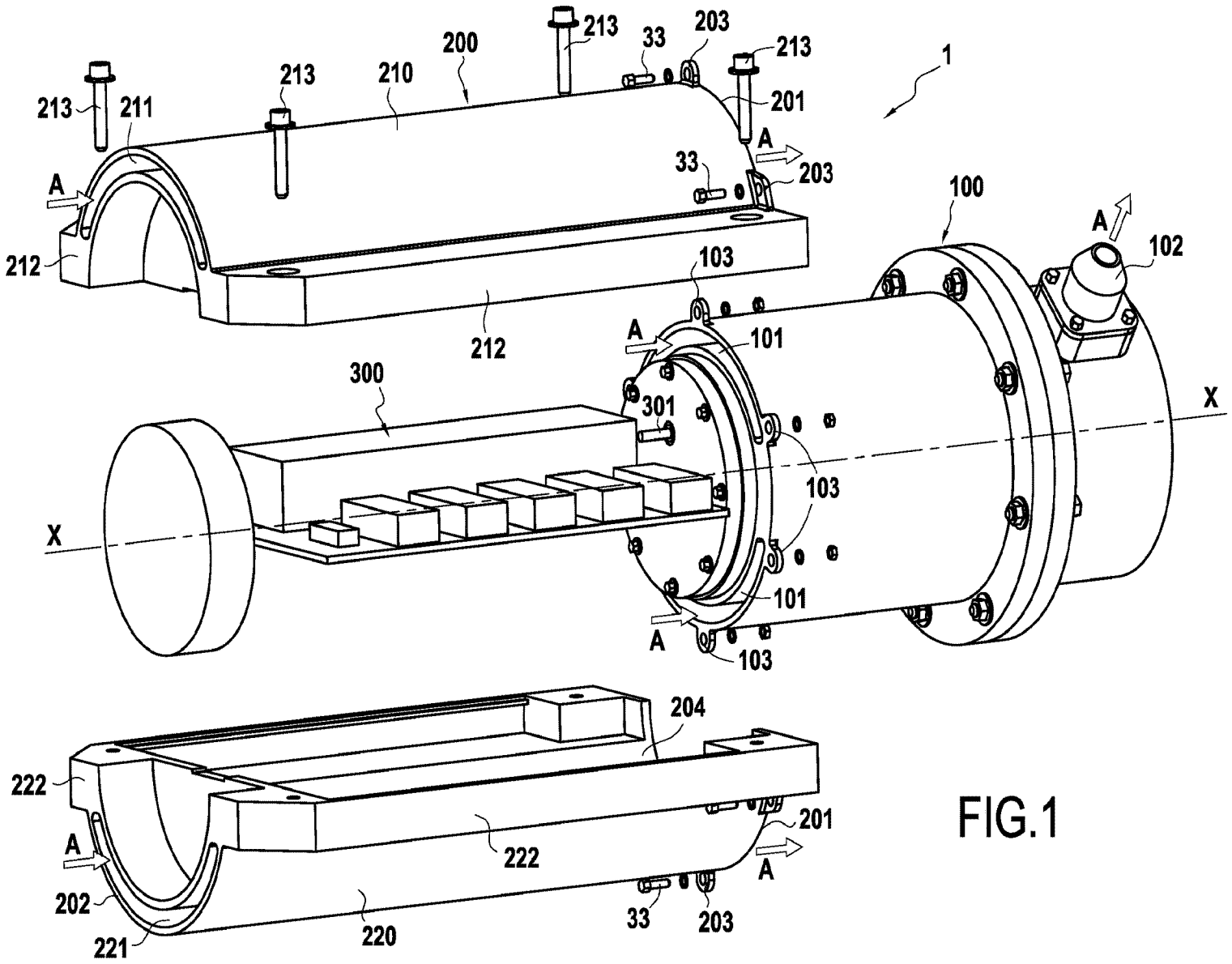
FIG. 1 is an exploded view of a system for generating air according to the invention.

FIG. 1 illustrates an exploded view of a system for generating air 1 comprising an electromechanical device 100, a casing 200 and an electronic card 300. The system for generating air which will be described can possibly, but not necessarily, be integrated into an aircraft, particularly into the turbine engine thereof.

The electromechanical device 100 is a device for generating an airflow comprising an air inlet opening 101 and an outlet 102. In FIG. 1, by way of an illustrative example, the electromechanical device 100 is a centrifugal air compressor, receiving via its opening 101 an airflow A routed from the casing 200. The circulation direction of the airflow A in the system for generating air 1 is symbolized by arrows in FIGS. 1 and 2. The air compressor compresses, via known means, the airflow A received from the opening 101, then expels it via an outlet 102. A compressor of this type can in particular be used in a fuel cell system for the purpose of supplying said battery with air. In another example, not illustrated, the electromechanical device 100 is a blower, for example a blower ensuring the circulation of air in the ventilation ducts. More generally, the electromechanical device 100 can be an electromechanical device generating an airflow comprising in particular rotating elements such as a wheel coupled to a drive motor.

Figure 2:
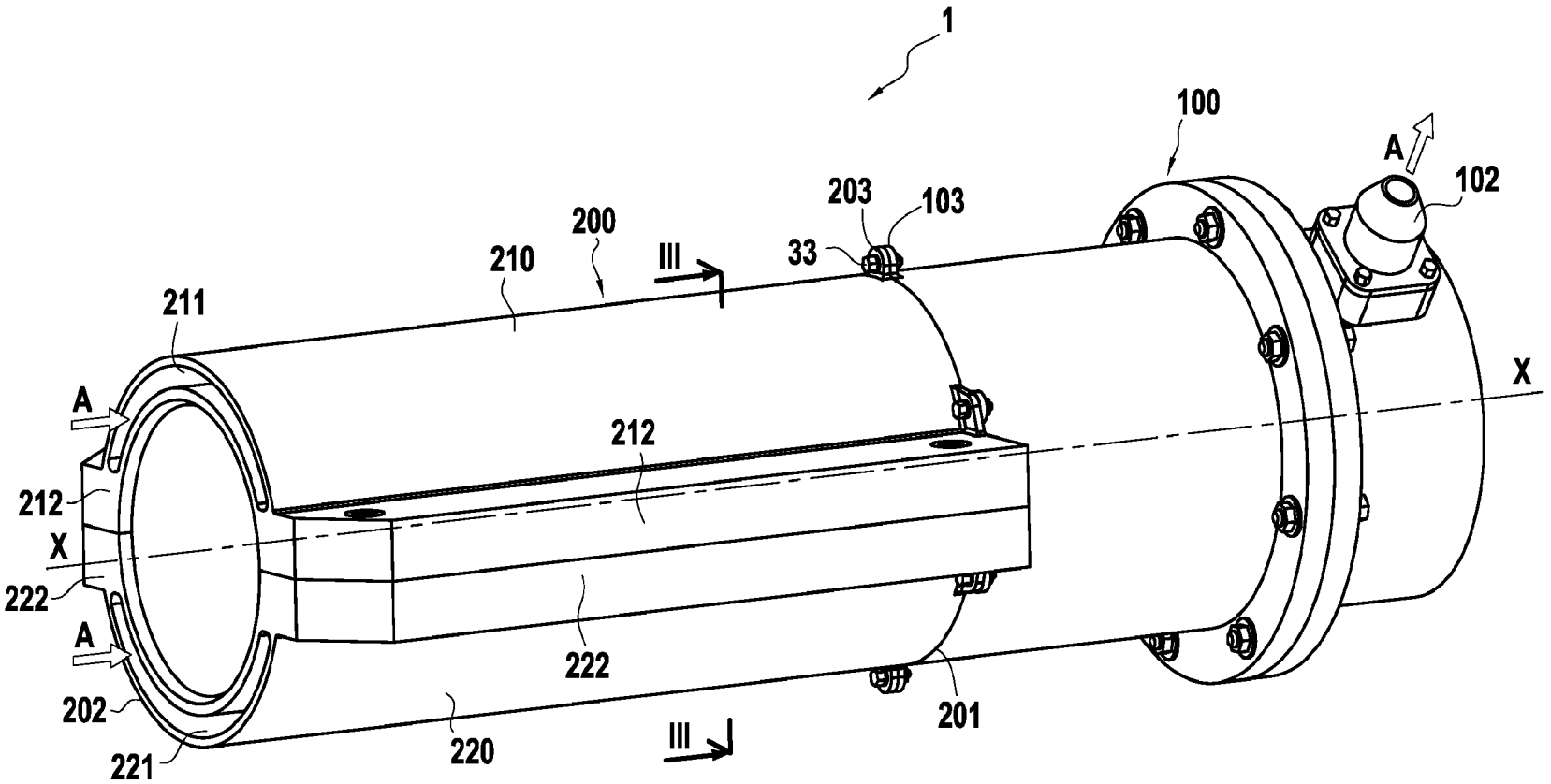
FIG. 2 is a perspective view of the system for generating air of FIG. 1 according to the invention.
Figure 3:
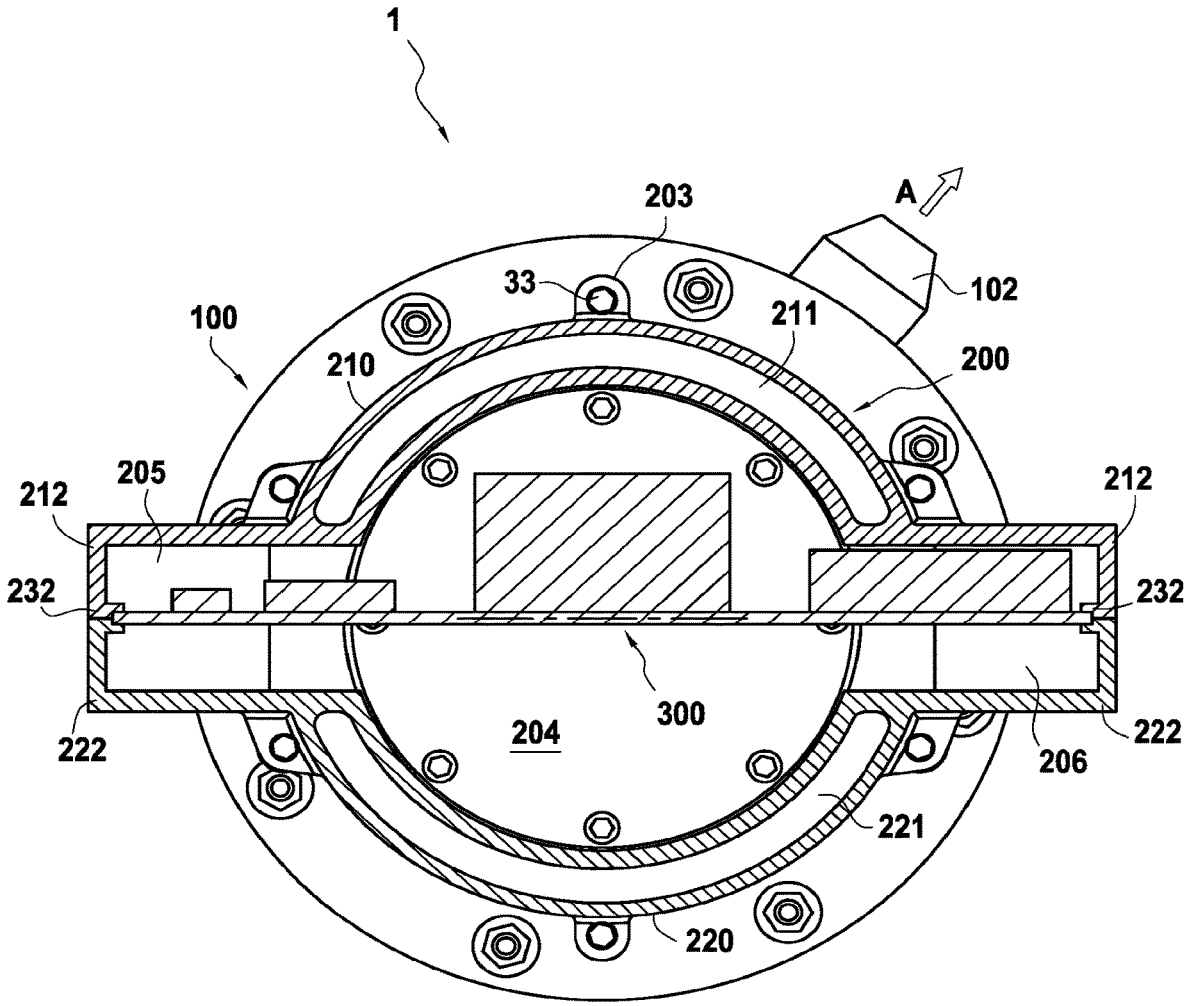
FIG. 3 is a section view of the casing of FIG. 1 along the section plane III-III.

The casing 200 extends along an axis X between a first end 201 attached to the air inlet opening 101 of the casing 200 and a second end 202 situated opposite the first end 201. To allow the attachment of the first end 201 to the opening 101, as can be seen in FIG. 1-3, flanges 203, 103 can, by way of an example, be created circumferentially, respectively around the casing 200 and the electromechanical device 100. Attachment means 33 of the screw and nut type can then allow their respective attachments. In other examples, not shown, other means can be considered in order to ensure the attachment of the first end 201 to the opening 101, for example by gluing or by welding the casing 200 to the electromechanical device 100.

The casing 200 is formed of two parts 210, 220 which, when they are assembled, define a closed recess 204 intended to receive the electronic card 300. In one exemplary embodiment, each part 210, 220 forming the casing 200 is made of aluminum, though other materials can be considered.

Each part 210, 220 comprises a hollow wall defining a channel 211, 221 extending between the two ends 201, 202 of the casing 200. At the first end 201, each channel 211, 221 opens in front of the air inlet opening 101 of the electromechanical device 100.

Thus, the electromechanical device 100 is supplied with air by air routed by the channels 211, 221. In other words, the parts 210, 220 can be seen as the lower and upper cowlings of the casing 1, each of these cowlings including an air stream defined by the channels 211, 221. The outlet of these air streams opens on the air inlet opening 101 of the electromechanical device 100. Each channel 211, 221 being formed in a distinct part 210, 220 of the casing 200, these channels are fluidly isolated from one another, as well as from the recess 204. The channels 211, 221 extend in the same direction according to the axis X along the recess 204 when the parts 210, 220 are assembled. In other words, the recess 204 intended for the electronic card 300, formed by the assembly of the first part 210 and the second part 220, is isolated from the airflow A passing through the channels 211, 221, these bypassing the recess 204. Thus, when the electronic card 300 is arranged in the recess 204, it is located in a median plane along the axis X of the electromechanical device 100 and is isolated from the airflow A passing through the channels 211, 221.

The attachment of the parts 210, 220 intended to form the casing 200 can be accomplished by means of flanges 212, 222, formed respectively along each part 210, 220, parallel to the axis X. These flanges 212, 222, also extend according to a radial direction perpendicular to the axis X. The flanges 212, 222 are created so as to define together a cavity 205, 206 in communication with the recess 204. The assembly of the flanges 212, 222 can, by way of an example, be accomplished via attachment means 213 of the screw-and-nut type, though other attachment means can be considered.

Thus, the assembly of two respective flanges 212, 222 on either side of each part 210, 220 of the casing 200 allows providing an additional volume for the insertion of the electronic card 300 between the parts 210, 220 of the casing 200. A part of the electronic card 300 is then housed in each of the cavities 205, 206.

The electronic card 300 can be retained in the recess 204 and the cavities 205, 206 by various means of attachment. By way of an example, in FIG. 3, the assembly of the flanges 212, 222 allows grooves 232 to be formed extending radially toward the interior of the casing 200, thus allowing the electronic card 300 to be retained. Other means of attachment can be considered, for example the electronic card 300 can be attached to one of the parts 210, 220 by a screw-and-nut system.

Moreover, for the purpose of optimizing the system for generating air 1, for example to use it in an aircraft, the shape of the parts 210, 220 can be adapted to the shape of the electromechanical device 100. For example, in the embodiment illustrated in the figures, the electromechanical device 100 has a substantially cylindrical shape along the axis X and its air inlet opening 101 has a circular shape. Consequently, the parts 210, 220 of the casing 200 are created in the shape of two half-cylinders. The casing 200 extends, in the example illustrated, in the continuation of the opening 101. For a geometry of this type, the channels 211, 221 then have a C-shaped cross section. An example of this type remains illustrative; other geometries can be considered, for example the casing can have a parallelepiped shape and its channels have rectangular or serrated shapes.

The electronic card 300 comprises electronic components for the control and/or power supply of the electromechanical device 100. As previously disclosed, this at least is arranged in the recess 204 formed by the assembly of the two parts 210, 220 of the casing 200, a part of this card being able to be housed in one or all of the cavities 205, 206. The electronic card 300 is therefore housed in the casing 200. Advantageously, the insertion of the electronic card 300 between the two parts 210, 220 of the casing 200 allows accomplishing at least one electrical connection 301 in direction communication with the electromechanical device 100. The electronic card 300 can thus be connected electrically with the electromechanical device 100 without passing through the first channel 211 or the second channel 221, and therefore has no impact on the air supply of the electromechanical device 100. Thus, for the purpose of ensuring the electrical connection of the electromechanical device 100 with the electronic components for control and/or power supply of the electronic card 300, no airflow stream is subjected to a degradation of performance linked to the presence of electrical connection elements passing through it.

The use of a single electronic card 300 arranged in the recess 204 also allows the accomplishment of a reduction in the number of electrical connections compared to existing solutions, by dispensing in particular with possible inter-card connections. Thus an improvement in volume and in mass is obtained in the electronics intended for the electromechanical device 100, as well as a reduction in the electromagnetic radiation emitted by the different electronic components.

The structure of the proposed casing 200 also allows ensuring effective cooling of the electronic component assembly of the electronic card 300. When an airflow A is aspirated at the inlet of the casing 200, that is at the second end 202, it penetrates into the channels 211, 221 and is routed by the latter. The air then circulates through the channels 211, 221 along the recess 204, the channels being separated from the recess 204 by a portion of the parts 210, 220, allowing the dissipation of the heat emitted by the components of the electronic card 300 by thermal conduction.

The invention claimed is:

1. A system for generating air comprising:

an electromechanical device generating an airflow equipped with an air inlet opening and an outlet;

a casing extending between a first end attached to the air inlet opening and a second end situated opposite the first end, said casing comprising two parts together defining a closed recess, each part comprising a hollow wall defining a channel extending between the two ends of the casing, each channel isolated from one to another opening in front of the air inlet opening so that the electromechanical device is supplied with air routed by the channels, bypassing the recess of the casing; and at least one electronic card for power supply and control of the electromechanical device arranged in the recess of the casing and isolated from the airflow passing through the channels.

2. The system for generating air according to claim 1, wherein the parts of the casing are attached together by flanges, two corresponding flanges together defining a cavity in communication with the recess of the casing, a part of the electronic card being housed in said cavity.

3. The system for generating air according to claim 1, wherein the air inlet opening of the electromechanical device is circular and the casing has a cylindrical shape.

4. The system for generating air according to claim 1, wherein the casing is made of aluminum.

5. The system for generating air according to claim 1, wherein the electromechanical device is an air compressor or a blower.

6. An aircraft turbine engine comprising:

a system for generating air according to claim 1.

7. An aircraft comprising:

a turbine engine according to claim 6.

* * * * *